US005998956A

United States Patent [19]

Saito

[11] Patent Number: 5,998,956

[45] Date of Patent: Dec. 7, 1999

[54] RECORDING APPARATUS

[75] Inventor: Hiroyuki Saito, Yokohama, Japan

[73] Assignee: Canon Kabushiki Kaisha, Tokyo, Japan

[21] Appl. No.: 08/943,009

[22] Filed: Oct. 2, 1997

[30] Foreign Application Priority Data

Oct. 3, 1996 [JP] Japan ..... 8-281818

[51] Int. Cl.[6] ..... B41J 29/00

[52] U.S. Cl. ..... 318/696; 318/685; 400/322; 400/903

[58] Field of Search ..... 347/117; 318/696, 318/685, 603, 632; 400/322, 903

[56] References Cited

U.S. PATENT DOCUMENTS

| | | | |
|---|---|---|---|
| 4,429,268 | 1/1984 | Yajima et al. | 318/696 |
| 4,641,073 | 2/1987 | Sawada | 318/696 |
| 4,642,544 | 2/1987 | Furumura et al. | 318/696 |
| 4,710,691 | 12/1987 | Bergstrom et al. | 318/696 |
| 4,869,610 | 9/1989 | Nishizawa et al. | 400/322 |
| 5,412,302 | 5/1995 | Kido et al. . | |

FOREIGN PATENT DOCUMENTS

| | | |
|---|---|---|
| 0 409 175 | 1/1991 | European Pat. Off. . |
| 63-59792 | 3/1988 | Japan . |
| 3-270692 | 12/1991 | Japan . |
| 7-163182 | 6/1995 | Japan . |

*Primary Examiner*—Paul Ip

*Attorney, Agent, or Firm*—Fitzpatrick, Cella, Cella & Harper

[57] ABSTRACT

A higher-performance, energy saving recording apparatus, having a stepping motor as a driving source, presumes an out-of-phase state of the stepping motor. Driving setting parameters of the stepping motor are changed when an out-of-phase state of the stepping motor is presumed.

8 Claims, 10 Drawing Sheets

RECORDING APPARATUS

BACKGROUND OF THE INVENTION

1. Field of the Invention

The present invention relates to a recording apparatus using a stepping motor and, more particularly, to a recording apparatus which uses a stepping motor in an optimal state.

2. Related Background Art

Conventionally, the print speed and consumption power are determined by several ways of predetermined setting. As for the print speed, for example, an ink-jet recording apparatus has print modes such as a high-quality mode that realizes normal print quality, a high-speed mode that realizes high-speed printing, a super-high quality mode that realizes highest quality, and the like, and the carriage is driven at different speeds in these modes. The speed is normally determined and set based on the relationship among the ink ejection frequency, the power of the motor to be used, and the weight of the carriage. As for consumption power, a means for suppressing consumption power during a print standby state or the like is used.

As for the motor to be used, in an image-quality priority model, a DC motor is driven by closed-loop control using an encoder as a position detection means. Normally, however, a low-cost pulse motor is driven by open-loop control. Also, closed-loop control using a pulse motor and an encoder is also available but is not popular.

Since the parameters of a conventional printer are set to guarantee the operation and specifications even in the worst environment or state, the print speed and consumption power are set to have some margins so that predetermined print quality and speed can be maintained anytime and anywhere. Among recording apparatuses that have become popular worldwide, since a recording apparatus with a stepping motor using open-loop control, which is advantageous in terms of cost, does not have any feedback control, the torque margin of the motor works under a strict condition at a certain place but with enough margin at another place. Also, recording apparatuses such as a new apparatus, used apparatus, and the like have various states. In this manner, the recording apparatus used often has an excessively large margin for the print speed and consumption power (over-specification state) depending on its use environment and state. In order to improve the performance of the recording apparatus and to attain energy savings, an appropriate margin must be maintained. As for the motor, an excessive margin leads to heat generation of the motor, and the torque characteristics also drop due to an increase in winding resistance and a decrease in coercive force.

SUMMARY OF THE INVENTION

The present invention has been made in consideration of the above situation and has as its object to use a stepping motor used in a recording apparatus in an optimal state.

It is another object of the present invention to change the driving setting parameters by presuming the out-of-phase state of carriage driving steps.

Other objects of the present invention will become apparent from the following description of the detailed embodiments.

DESCRIPTION OF THE PREFERRED EMBODIMENTS

The embodiments of the present invention will be described hereinafter with reference to the accompanying drawings.

(First Embodiment)

Figure 1:
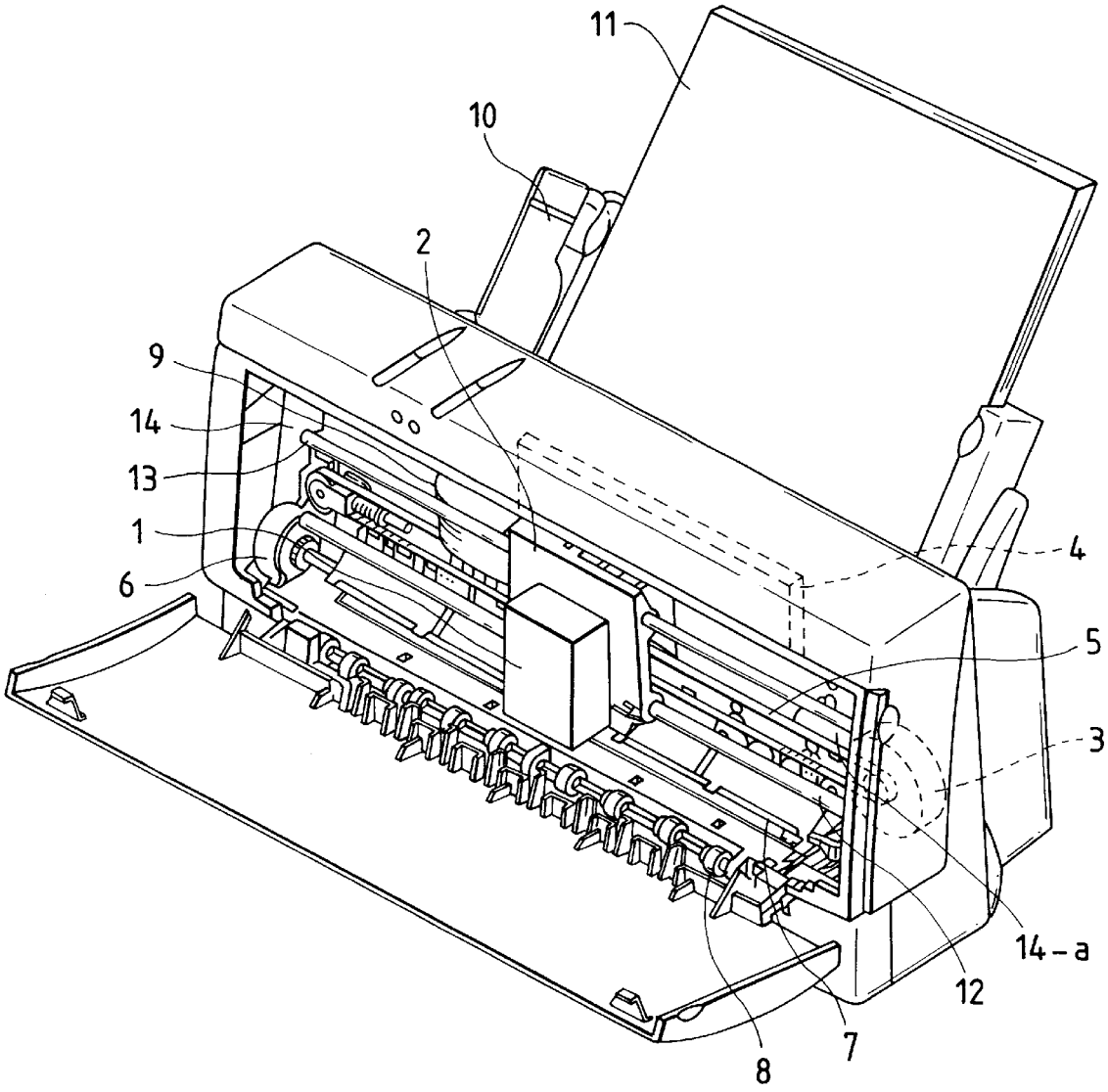
FIG. 1 is a perspective view of an ink-jet printer apparatus according to the first embodiment of the present invention.
Figure 2:
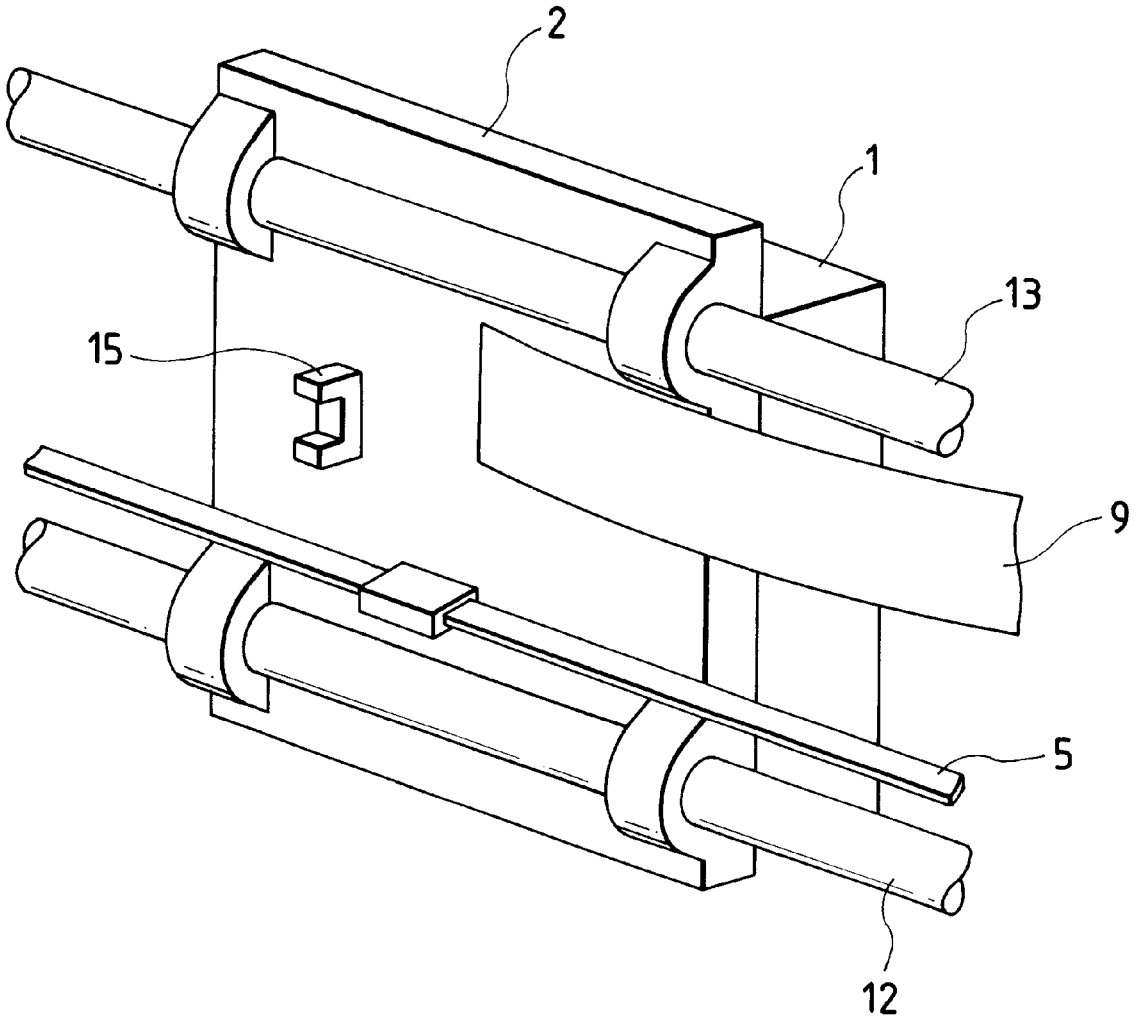
FIG. 2 is a detailed perspective view of a carriage shown in FIG. 1.

An ink-jet printer using a stepping motor according to the first embodiment of the present invention will be described below with reference to FIGS. 1 and 2. FIG. 1 is a perspective view of the ink-jet printer of this embodiment, and FIG. 2 is a perspective view of a carriage unit.

Referring to FIG. 1, a logic board 4 serves as a control unit of this printer. Recording media 11 are stacked on a paper feed means 10. An LF motor 6 is used as a stepping motor. The recording media 11 are fed one by one by rotating a separation roller (not shown) provided to the paper feed means 10 by the LF motor 6 driven by a power supply (not shown). (The driving force of the LF motor 6 rotates, by means of a pendulum gear (not shown) provided to an LF roller 8, a convey means 7 when the motor rotates in the normal direction, and rotates the separation roller (not shown) of the paper feed means 10 when the motor rotates in the reverse direction.)

The fed recording medium 11 is conveyed by the convey means 7. A recording head 1 with ink is mounted on a carriage 2, which is driven by a CR motor 3 as a stepping motor. The carriage 2 that mounts the recording head 1 is guided and supported by a guide shaft 12 and a support shaft 13 attached to a chassis 14, and is movable in the main scanning direction. The output of the CR motor 3 driven by a power supply (not shown) is transmitted to the carriage 2 via a belt 5 to reciprocally move the carriage 2 in the main scanning direction. While the carriage 2 is reciprocally moving on the recording medium 11, a signal output from the logic board 4 is input to the recording head 1 via a cable 9, and ink is ejected from a nozzle portion, thus forming an image. After image formation, the recording medium 11 is exhausted by an exhaust means 8.

This printer performs open-loop control which uses a stepping motor as the CR motor 3 and controls the position of the carriage 2 on the basis of input pulses generated by the logic board 4 without using any encoder for detecting the position of the carriage 2. In order to initialize the position of the carriage 2, as shown in FIG. 2, a home position sensor 15 is mounted on the carriage 2, and detects the carriage position when it crosses an upright portion 14-*a* of the chassis 14. Note that the upright portion 14-*a* of the chassis is located at a position where the home position sensor 15 mounted on the carriage crosses during printing.

Figure 3:
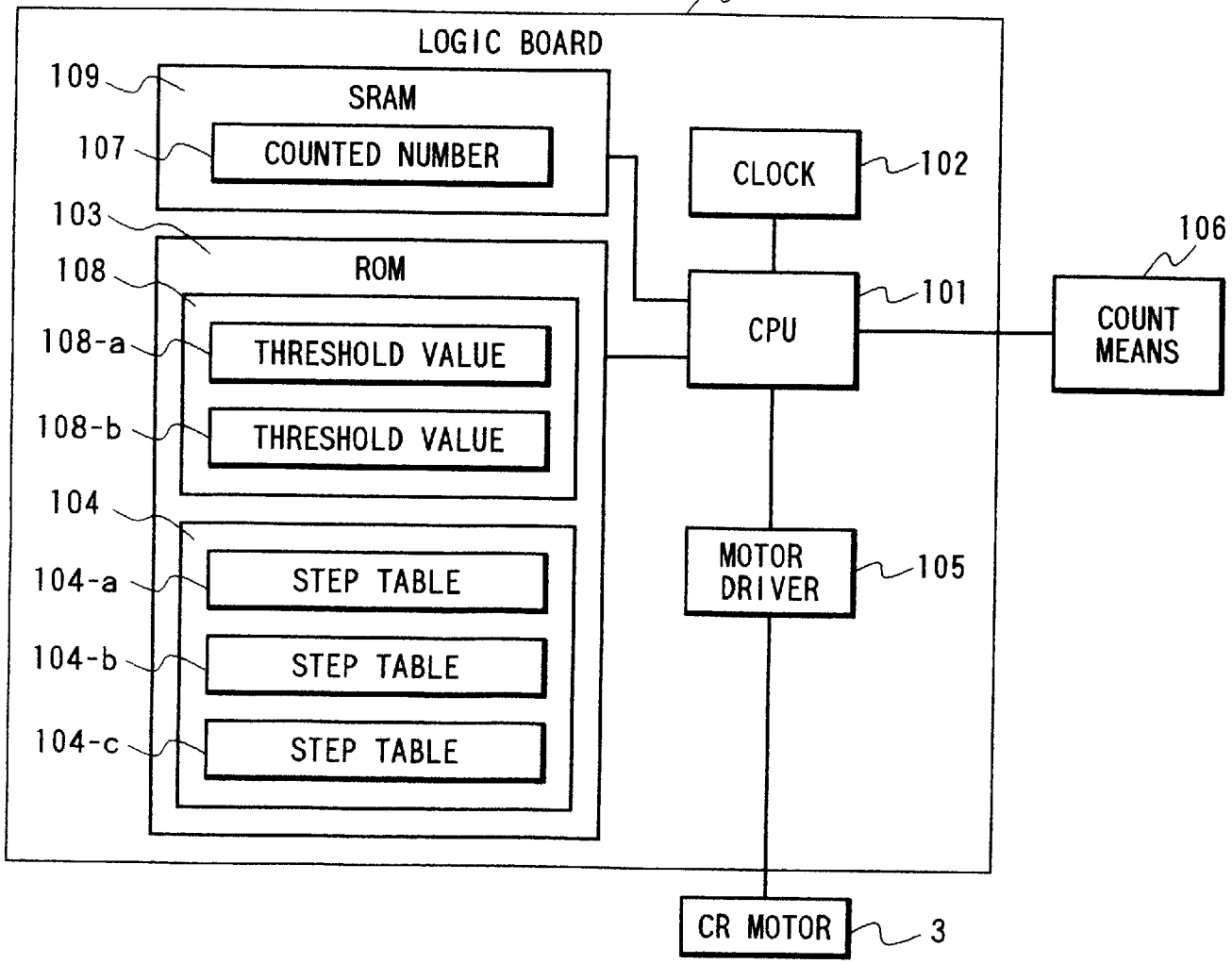
FIG. 3 is a control circuit block diagram of the apparatus shown in FIG. 1.

FIG. 3 is a block diagram showing the control system of the first embodiment. The control system shown in FIG. 3 comprises a central processing unit (to be referred to as a CPU hereinafter) 101 for controlling the ink-jet printer, a clock 102 for outputting signals at a predetermined period to define timings, a static RAM (SRAM) 109 for storing a counted number 107 of carriage scanning or scans a ROM 103 that stores a step table 104 of a pulse rate for driving the CR motor 7, and a threshold value 108 to be compared with the counted number 107, a driver 105 for driving the CR motor, and a count means 106 for counting the number of scanning (the number of reciprocal movements) of the carriage 2.

The CPU 101, clock 102, ROM 103, and driver 105 are mounted on the logic board 4 in a compact state. The ROM 103 stores a plurality of step tables 104 each corresponding to the number of total carriage scanning. A plurality of threshold values 108 are prepared when three or more step tables 104 are stored. In this embodiment, three different step tables 104 (104-*a*, 104-*b*, and 104-*c*) and two different threshold values 108 (108-*a* and 108-*b*) are prepared. The step table 104-*c* defines a curve for the lowest print speed, which is the manufacturer's guaranteed speed at which motor operation is assured in a guaranteed environment and state. The print speed increases in the order of tables 104-*b* and 104-*a*.

Note that flags for detecting the manufacturer's guaranteed speed are prepared in these step tables, and the flag of the table 104-*c* alone is ON. The threshold value 108-*a* corresponds to a count boundary value between the tables 104-*a* and 104-*b*, and the threshold value 108-*b* corresponds to a count boundary value between the tables 104-*b* and 104-*c*. Normally, in the ink-jet printer, a plurality of different print modes with different print speeds such as an HS (high-speed) mode, an HQ (high-quality) mode, and the like are prepared in correspondence with the print quality to be output. In this embodiment, a plurality of step tables (104-*a*, 104-*b*, and 104-*c*) with different speeds are prepared for one of these print modes, e.g., the HS mode. That is, upon changing the print speed, the throughput changes but the print quality remains the same.

Figure 4:
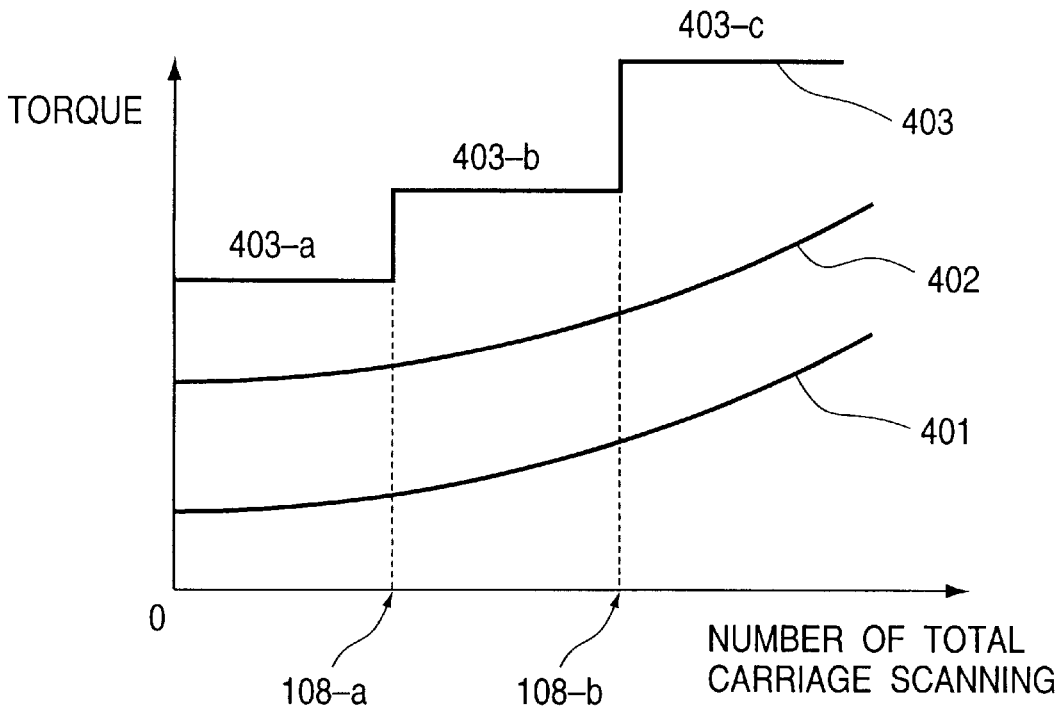
FIG. 4 is a graph showing the relationship between the number of carriage scanning and torque of a carriage driving motor shown in FIG. 1.

The method of setting the step table 104 and the threshold value 108 will be described below with reference to FIGS. 4 and 5. FIG. 4 shows changes in mechanical resistance (converted into a torque) and changes in torque with respect to the number of total carriage scanning. In FIG. 4, a curve 401 represents the mechanical resistance that changes depending on the number of carriage scanning. A curve 402 represents the torque required for scanning the carriage 2 in consideration of the inertial components of the recording head 1 and an ink tank 4, i.e., the presumed out-of-phase or step-out torque (strictly, the out-of-phase limit torque). A curve 403 represents the motor output torque. When the number of carriage scanning increases, the mechanical resistance 401 increases due to an increase in sliding resistance between the carriage 2, and the guide shaft 12, support shaft 13, and the like (the characteristic deterioration of the motor is also converted into a resistance). This is mainly caused by worn members and insufficient oil (grease). When the resistance increases, the torque (presumed out-of-phase torque) 402 required for driving the carriage 2 increases. The presumed out-of-phase curve is obtained in advance theoretically or empirically.

Normally, the motor output torque corresponding to the manufacturer's guaranteed speed is set to have a margin, so that the required torque is satisfied when the number of carriage scanning has reached a durability limit number. The torque at that time is a torque 403-*c*. However, when the number of carriage scanning is smaller than the durability limit number, since the mechanical resistance is also small, the output torque 403-*c* is not always required. For this reason, the threshold values 108-*a* and 108-*b* are set for the number of carriage scanning, and motor output torques 403-*a* and 403-*b* are calculated from the torques required within the ranges defined by these threshold values.

Figure 5:
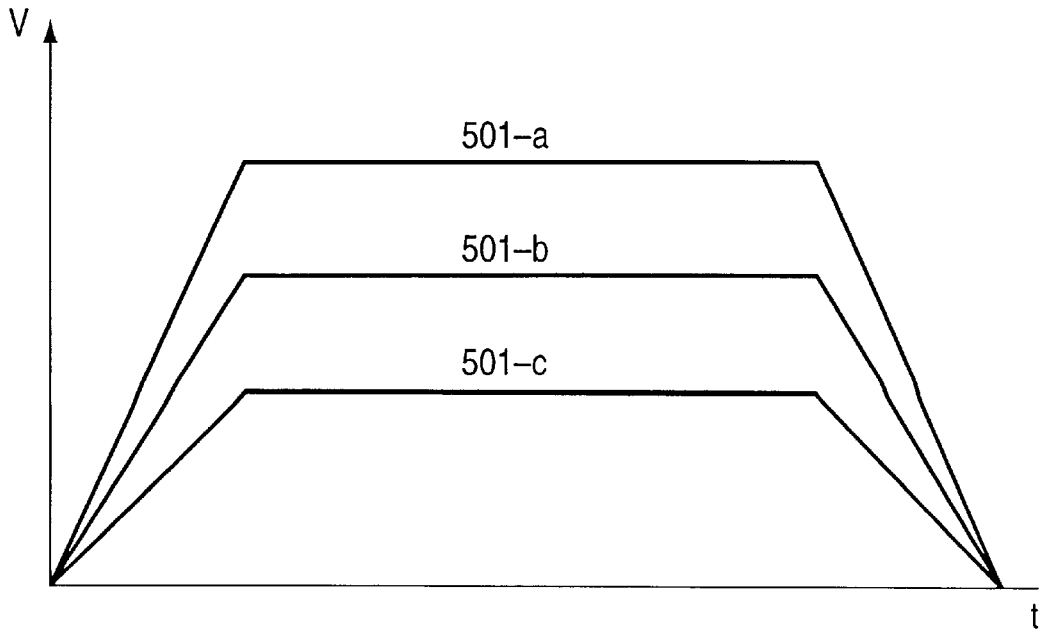
FIG. 5 is a graph showing the relationship between the carriage driving speed and torque of the carriage driving motor shown in FIG. 1.

FIG. 5 shows motor speed curves 501 corresponding to motor output torques 403. The stepping motor has characteristics in that the output torque becomes smaller as the speed becomes higher. Based on such characteristics, motor speed curves 501-*a*, 501-*b*, and 501-*c* are determined in correspondence with the motor output torques 403-*a*, 403-*b*, and 403-*c* in FIG. 4. Then, the step tables 104-*a*, 104-*b*, and 104-*c* that realize these motor speed curves are determined.

The carriage scanning speed can be changed in correspondence with the number of carriage scanning on the basis of the relationship data among the number of carriage scanning, the out-of-phase torque, and the driving speed of the motor. The above-mentioned threshold values 108 and the step tables 104 are determined and stored in advance in consideration of variations of the motor and machine.

Figure 6:
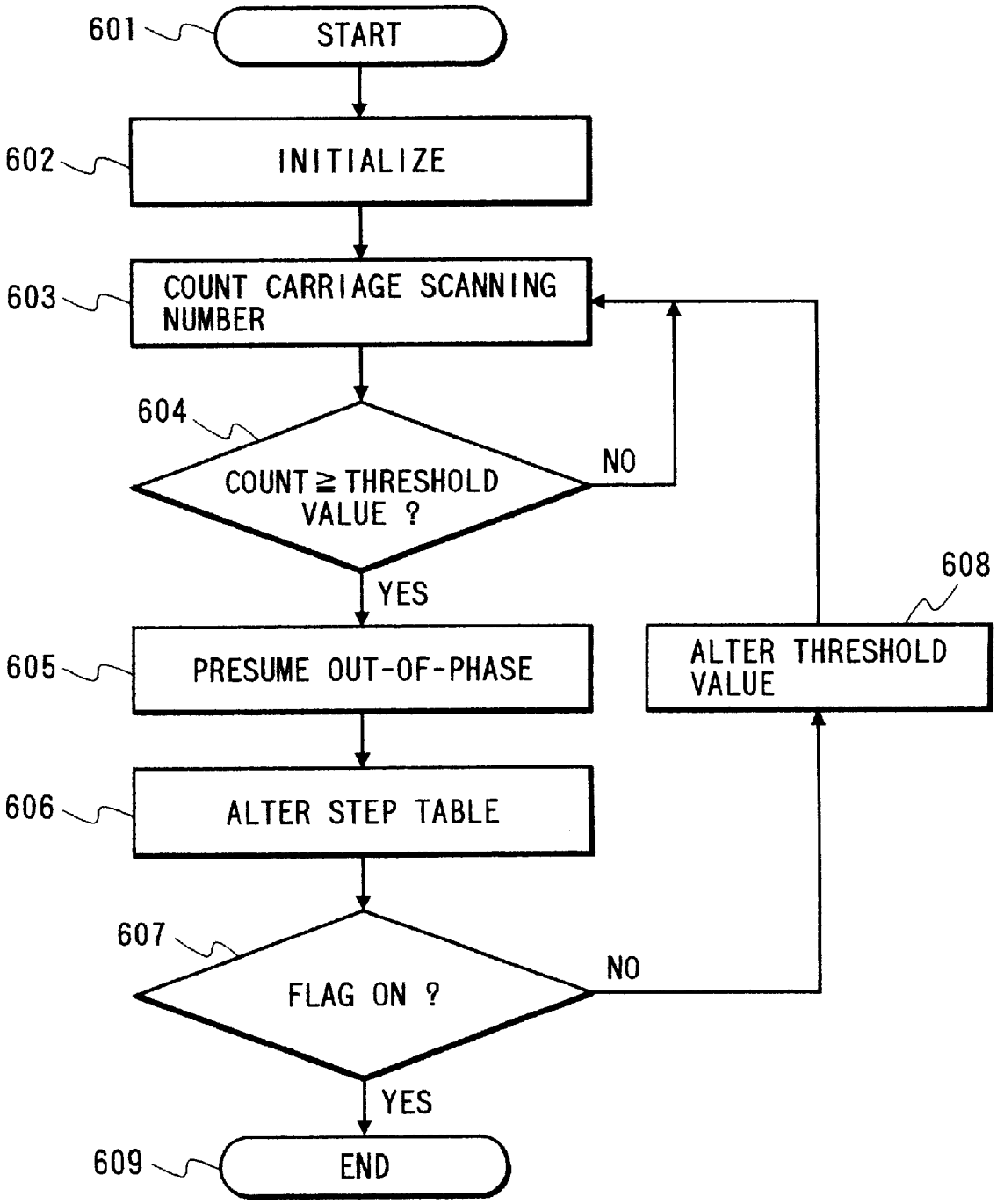
FIG. 6 is a flow chart of the control circuit shown in FIG. 3.

FIG. 6 is a flow chart showing the control sequence of the circuit shown in the block diagram of FIG. 3. In FIG. 6, the flow starts at the beginning of use of the printer, e.g., upon initialization of the printer delivered from a factory (step 601). The individual parameters are initialized (step 602) to reset the counted number 107 in the static RAM (SRAM) 109 to zero, to select the table 104-*a* that realizes the highest print speed as the step table 104 for the CR motor 3, and to select the smallest value 108-*a* as the threshold value 108 if a plurality of threshold values are available. Note that the step table 104-*a* selected in step 602 realizes a print speed higher than that guaranteed by the manufacturer.

At this time, the number of carriage scanning is counted all the time (step 603) until the flow ends, and the counted number 107 is overwritten every time the carriage 2 reciprocally moves to form an image. The counted number need not always be overwritten during printing, but may be overwritten after the recording medium is exhausted or printing is complete. Every time the counted number 107 is overwritten, it is compared with the selected threshold value 108 (step 604). At this time, if the counted number 107 is smaller than the threshold value 108-*a*, counting continues. On the other hand, if the counted number 107 is equal to or larger than the threshold value 108-*a*, it is determined that the number of carriage scanning has reached a number that will cause an out-of-phase state if carriage scanning is repeated any more (presume out-of-phase) (step 605), and the step table 104-*a* is altered to the step table 104-*b*, thus altering the carriage scanning speed (step 606). At this time, the ink ejection frequency is changed in correspondence with the carriage scanning speed to accomplish image formation.

It is then checked if the manufacturer's guaranteed speed detection flag is ON in the step table 104-*b* (step 607). If YES in step 607, the flow advances to step 609 to end the flow. In this case, however, since the flag is OFF, the flow advances to step 608. In step 608, the threshold value 108-*a* is altered to the threshold value 108-*b*. Thereafter, counting of the number of carriage scanning continues (step 603), and the out-of-phase state is presumed when the counted value 107 has become equal to or larger than the new threshold value 108-*b* (step 605), thus altering the step table 104 again (step 606). In this case, the step table 104-*b* is altered to the step table 104-*c*, and the carriage 2 is scanned at the manufacturer's guaranteed speed. Also, the flag indicating the manufacturer's guaranteed speed is turned on. When that flag is checked in the next loop (step 607), since the flag indicating the manufacturer's guaranteed speed is ON, the flow advances to step 609 to end the flow. Thereafter, the carriage 2 is kept scanned at the manufacturer's guaranteed speed.

This flow is executed without informing the user of the current carriage scanning speed state. Alternatively, the degree of use of the printer estimated from the carriage scanning state on the basis the threshold value 108 and step table 104 in use may be displayed on a display unit (not shown) of the printer or on the screen of a host to inform the user of it, and the user may use such information as a criterion for determining the replacement timing of the printer. Such operation can be realized by a simple method. On the other hand, the counted number 107 of carriage scanning may be read as information and the printer use state of the user may be detected upon service maintenances.

The out-of-phase torque of the CR motor 3 is presumed on the basis of the number of carriage scanning, and the highest scanning speed that can drive the carriage without t causing the out-of-phase state can be realized. Also, an excessive margin due to different use states (the number of carriage scanning) can be prevented from being allowed, and motor driving with high performance is attained. Such driving can be easily realized with low cost without using any dedicated mechanism or sensor.

The above embodiment takes the CR motor 3 as an example, but may be applied to any other stepping motors such as the LF motor 6 or the like, the step table of which can be altered. In the case of the LF motor, the number of times of using the LF motor driving system can be easily obtained by counting the number of prints using a PE (paper end) sensor (not shown). Also, the out-of-phase presuming means detects the number of carriage scanning (the total use rotation amount of the motor) but may detect the use time of the motor by counting the total output time of pulses for driving the motor.

In this embodiment, an excessive margin is changed to an appropriate margin by altering the step table of the stepping motor to increase the carriage scanning speed. Likewise, the speed may remain the same, and the currents or voltages may be dropped. For example, the currents may be dropped by changing a PWM table to keep an appropriate margin. In this case, consumption power can be reduced, and heat generation of the motors and drivers can be prevented, thus preventing deterioration of the performance due to a low torque caused by temperature rise.

(Second Embodiment)

Figure 7:
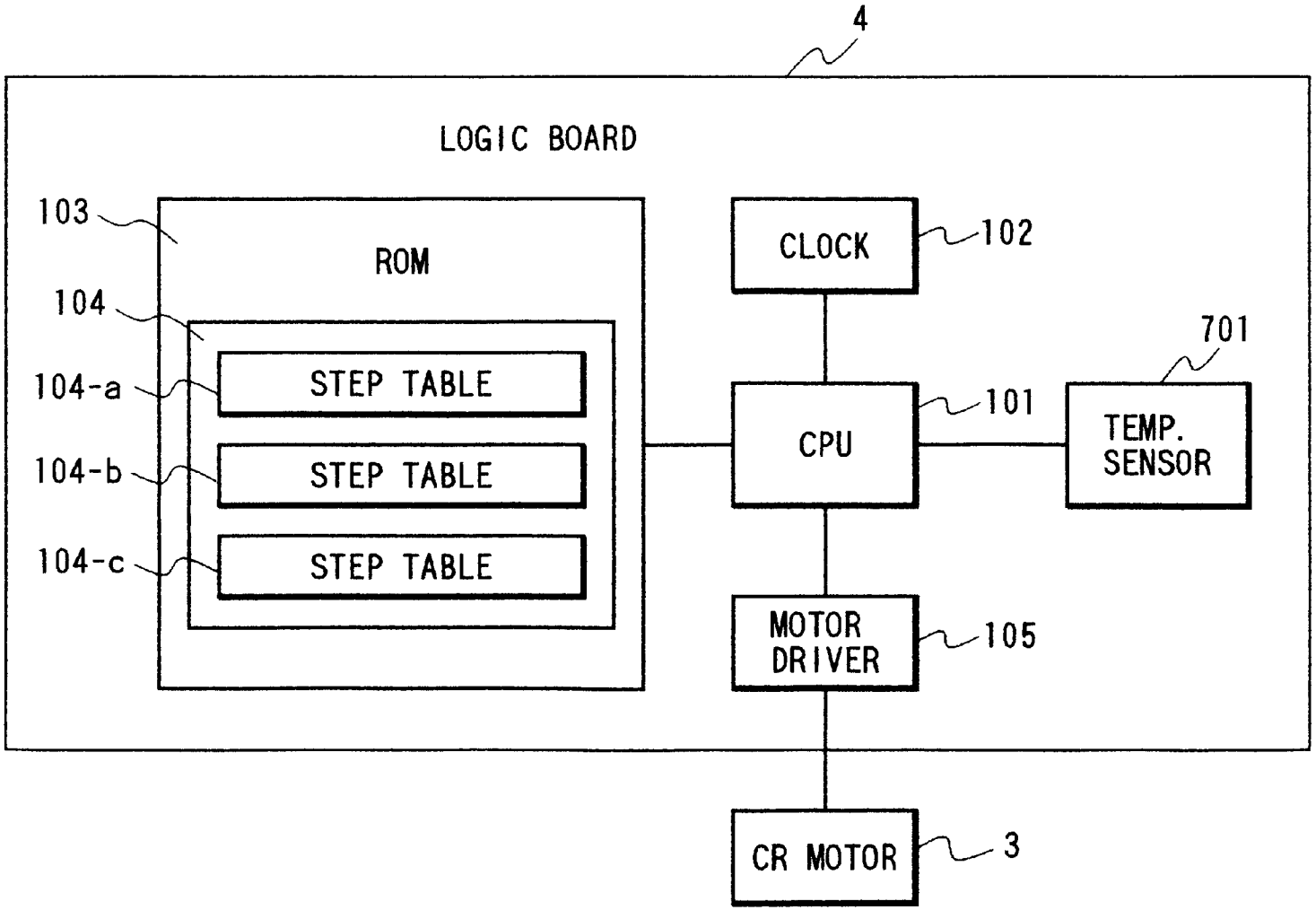
FIG. 7 is a block diagram of a control circuit of a recording apparatus according to the second embodiment of the present invention.

FIG. 7 is a block diagram showing the control system of the second embodiment. The printer used in this embodiment is the ink-jet printer shown in FIG. 1 of the first embodiment. In FIG. 7, a temperature sensor (a sensor such as a thermistor or the like) measures the atmospheric temperature of the printer. Other reference numerals in FIG. 7 denote the parts having the same functions as those in FIG. 3 of the first embodiment. The ROM 103 stores a plurality of step tables 104. In this embodiment as well, these tables do not depend on print quality. Neither the counted number 107 nor threshold values 108 used in the first embodiment are required in this embodiment.

Figure 8:
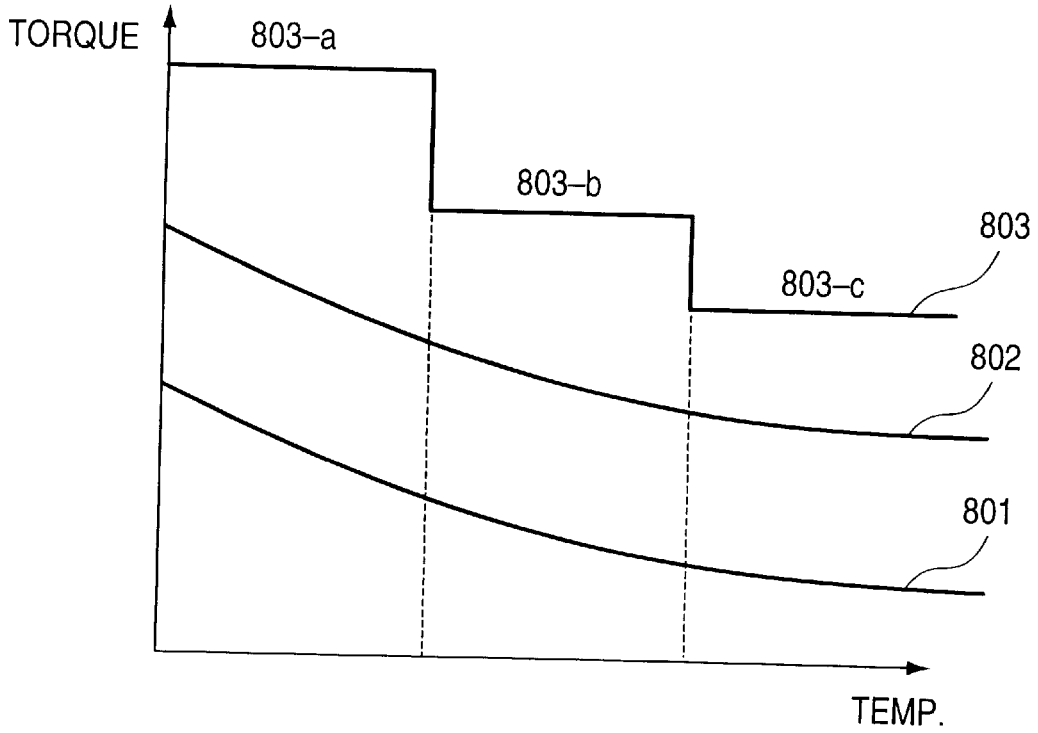
FIG. 8 is a graph showing the relationship between the number of carriage scanning and torque of a carriage driving motor shown in FIG. 7.

FIG. 8 shows the relationship between the mechanical resistance (converted into a torque) and the required torque (presumed out-of-phase torque) with respect to temperature. In FIG. 8, a curve 801 represents the mechanical resistance. In consideration of changes in viscosity and surface activation state of oil (grease), and thermal expansion of the parts, the mechanical resistance normally decreases as the temperature rises, as shown in FIG. 8. A curve 802 represents the required torque (presumed out-of-phase torque) corresponding to the curve 801. A curve 803 represents the motor output torque obtained by adding a margin to the required torque. A plurality of motor output torques (803-*a*, 803-*b*, and 803-*c*) are set in correspondence with some temperature ranges.

Figure 9:
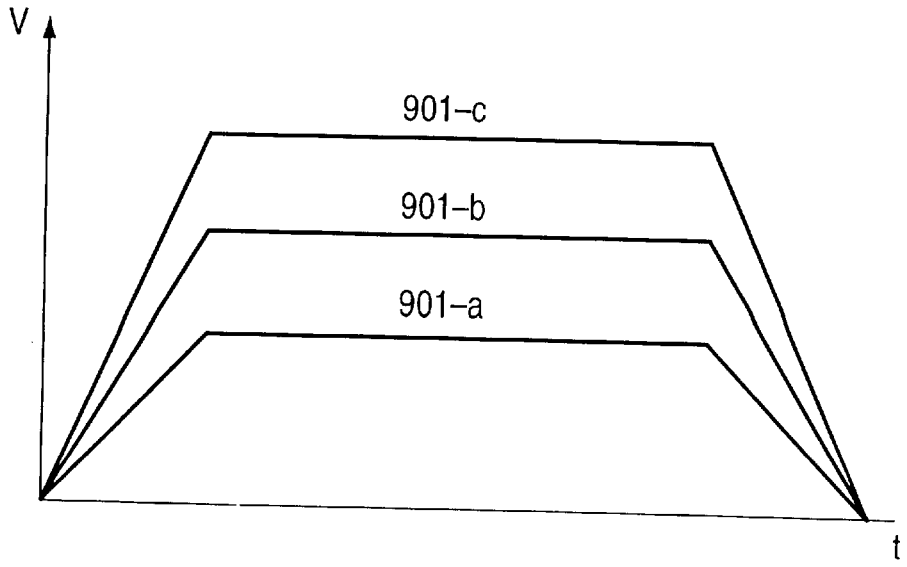
FIG. 9 is a graph showing the relationship between the carriage driving speed and torque of the carriage driving motor shown in FIG. 7.

FIG. 9 shows the relationship between the motor output and the carriage scanning speed. In order to keep a constant margin based on the speed vs. torque characteristics of the stepping motor, carriage scanning speed curves 901-*a*, 901-*b*, and 901-*c* are obtained in correspondence with the motor output torques 803-*a*, 803-*b*, and 803-*c*. Step tables 104-*a*, 104-*b*, and 104-*c* for motor driving realize these speed curves. Among these tables, the table 104-*a* that defines the lowest speed corresponds to the manufacturer's guaranteed speed.

Figure 10:
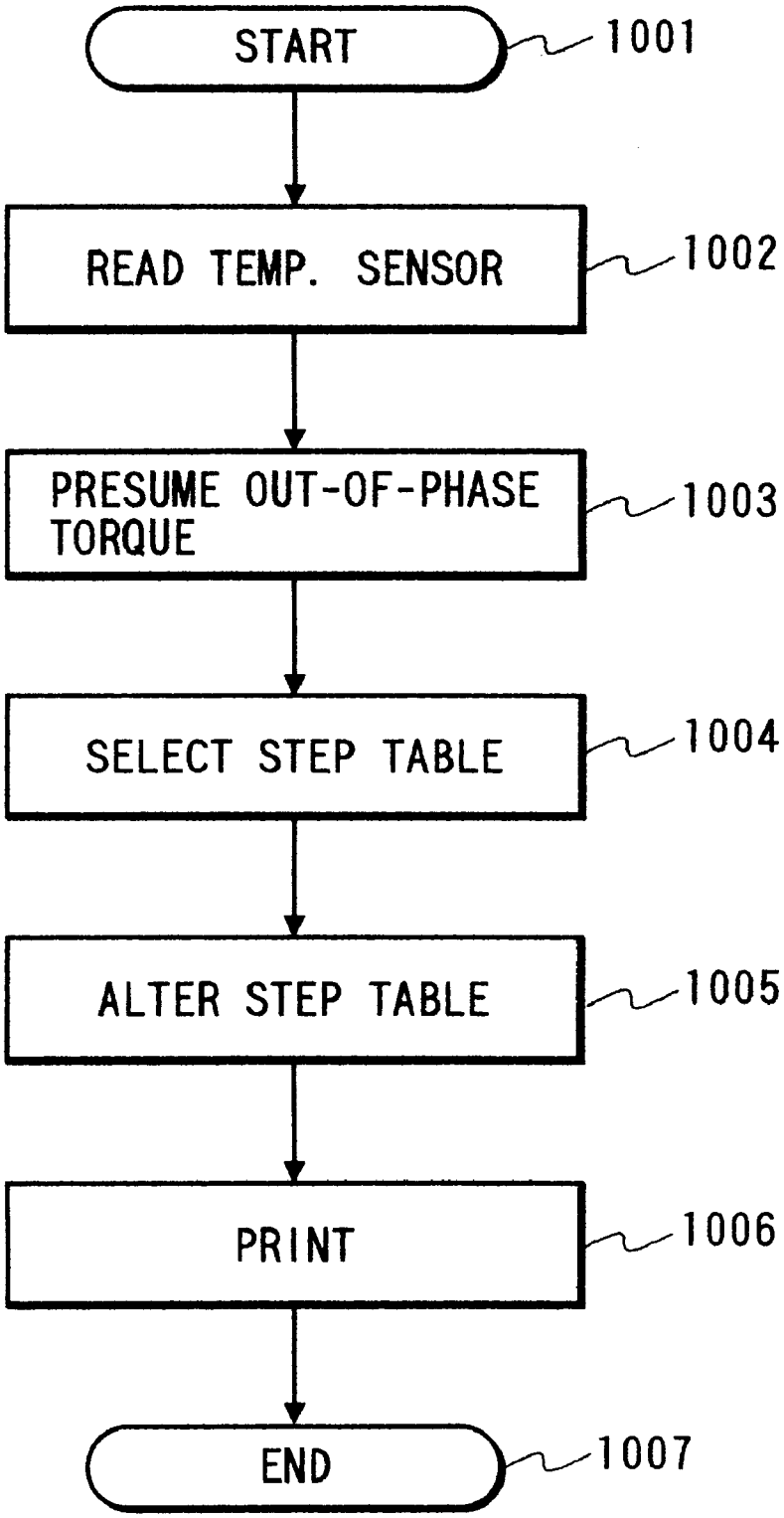
FIG. 10 is a flow chart of the control circuit shown in FIG. 7.

FIG. 10 is a flow chart showing the control. Print data is input, and the flow starts in step 1001. The value of the temperature sensor is read (step 1002). It is determined based on the read value that the margin until the out-of-phase torque is reached has changed due to a temperature rise (or drop) from temperature-carriage scanning speed data prepared in advance (presume the out-of-phase torque; step 1003), and a step table 104 that satisfies the corresponding carriage scanning speed is selected (step 1004). The table used so far is altered to the selected table (step 1005). At this time, the ink ejection frequency is also changed. Printing is done using the selected table (step 1006), and the flow ends (step 1007).

The ambient temperature is monitored at the beginning of printing. However, the present invention is not limited to the specific monitor timing, monitor time, and table alteration timing. For example, in order to reduce the number of interruptions and to stabilize the operation, the temperature may be monitored all day long to obtain the lowest temperature, and the table may be altered on the basis of the temperature obtained by adding a predetermined margin to the lowest temperature. When the temperature has changed during printing, and the out-of-phase torque may be reached, an error sequence that resumes the manufacturer's guaranteed speed may be executed.

The temperature sensor is arranged on the logic board. Alternatively, a temperature sensor used in temperature control of the recording head 1 may be used, or changes in winding resistance of the motor with respect to changes in temperature may be used as a sensor.

In this embodiment as well, the motor to be controlled is not limited to the CR motor 3, and the torque margin of the motor may be used to obtain a current or voltage drop in place of alteration of the motor speed.

By executing this embodiment, printing with high performance can be done in correspondence with the use environment (temperature).

(Third Embodiment)

Figure 11:
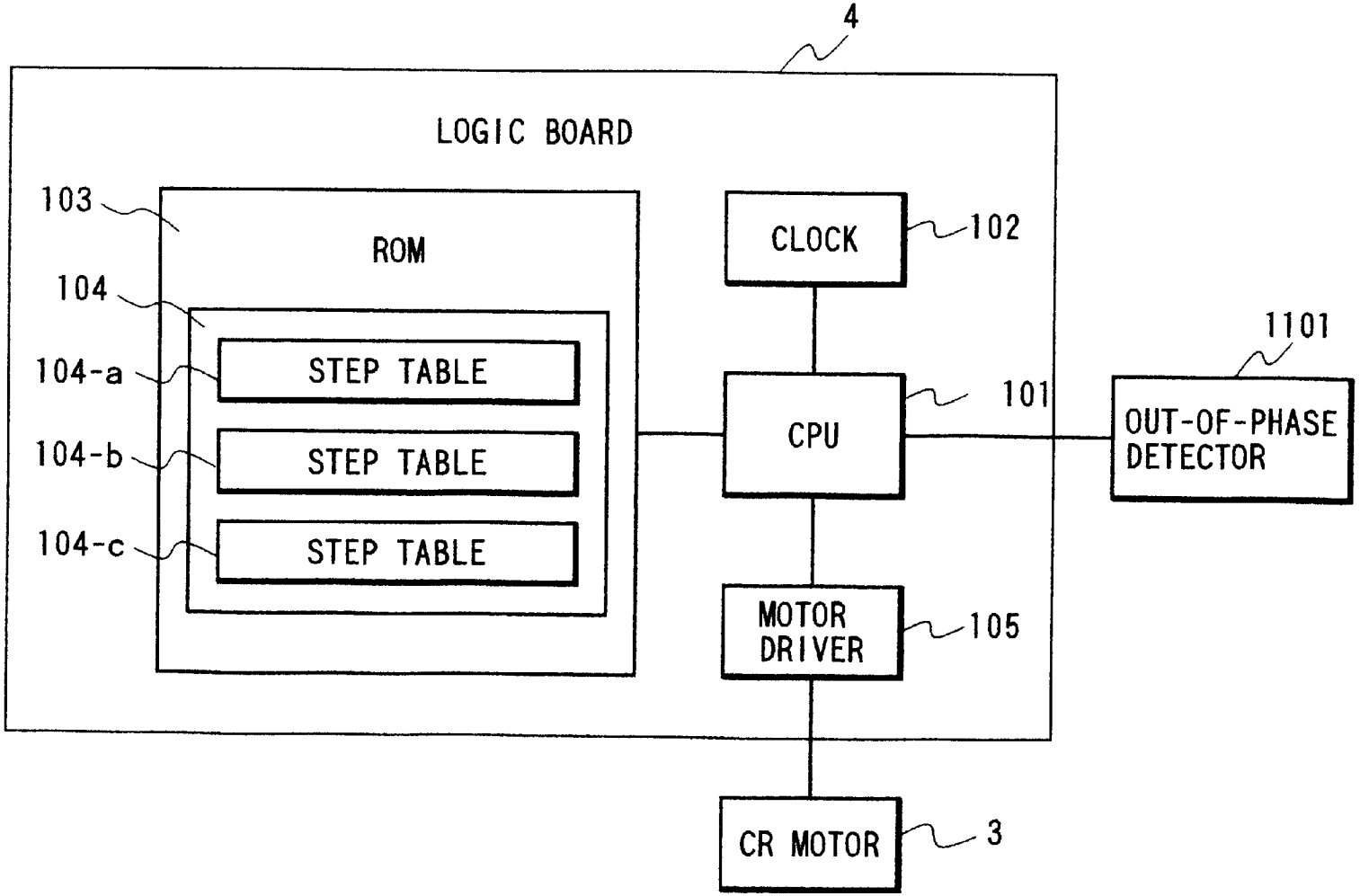
FIG. 11 is a block diagram of a control circuit of a recording apparatus according to the third embodiment of the present invention.

FIG. 11 is a block diagram showing the control system of the third embodiment. The printer used in this embodiment is the ink-jet printer shown in FIG. 1 of the first embodiment. In FIG. 11, an out-of-phase detector detects the out-of-phase state of the motor. Other reference numerals in FIG. 11 denote the parts having the same functions as those in FIG. 3 of the first embodiment. The ROM 103 stores a plurality of step tables 104. In this embodiment, the ROM 103 stores a low-speed step table 104-*a* corresponding the manufacturer's guaranteed speed, and middle- and high-speed tables 104-*b* and 104-*c*. In this embodiment, three different tables are prepared, but a plurality of tables need only be prepared and the number of tables is not limited to 3. Also, these tables do not depend on print quality. Neither the counted number 107 nor threshold values 108 used in the first embodiment are required in this embodiment. The out-of-phase detector uses a method of detecting an out-of-phase state by checking, using an H sensor 16 of the carriage 2, if the carriage 2 crosses the sensor at a normal timing during carriage scanning, a method of monitoring a voltage value obtained by converting a current value by utilizing a phenomenon in that the input current waveform of the motor changes due to out-of-phase (caused by changes in inductance) (Japanese Patent Application Laid-Open No. 63-59792), or the like.

Figure 12:
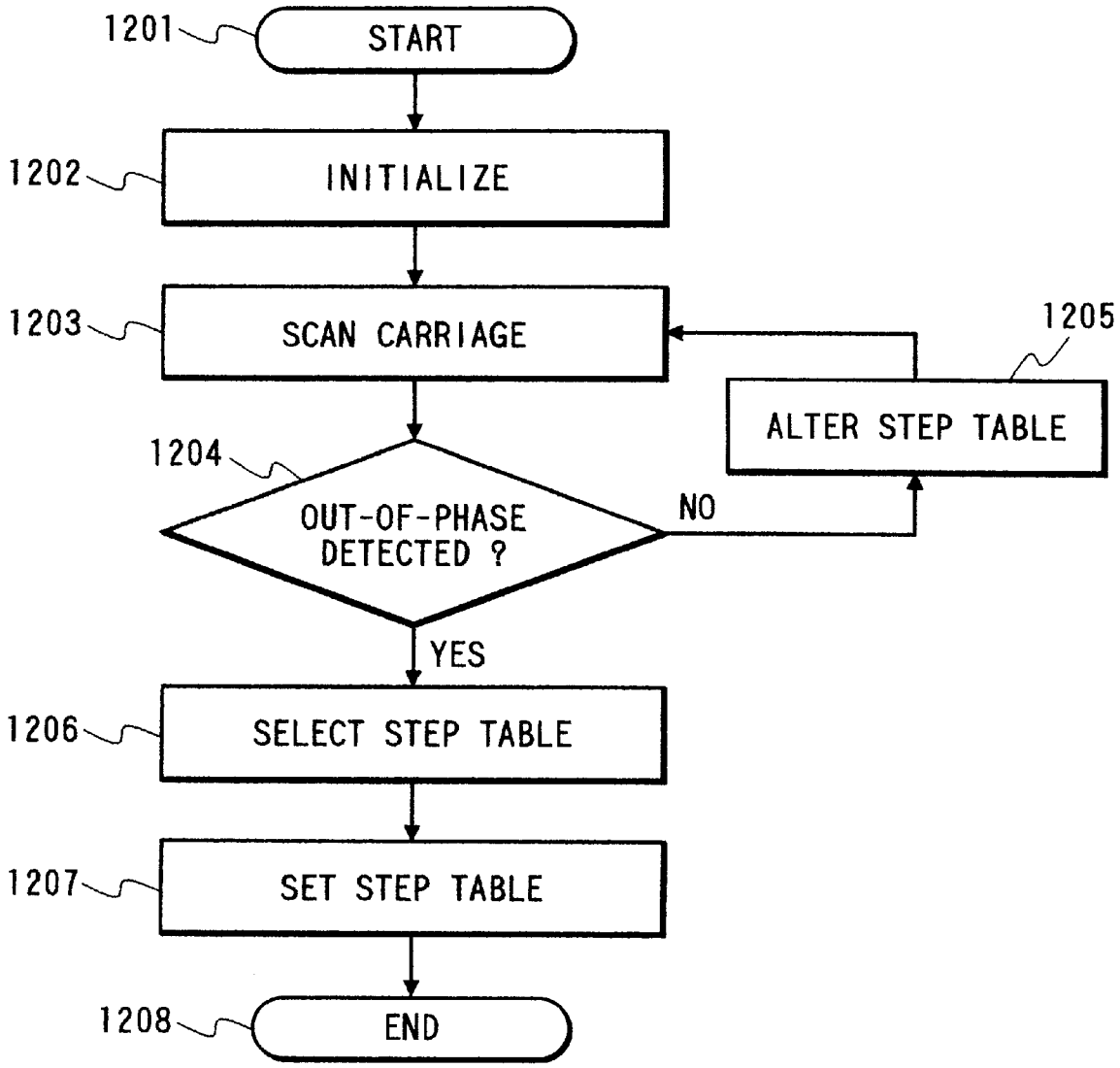
FIG. 12 is a flow chart of the control circuit shown in FIG. 11.

FIG. 12 is a flow chart of the control method. The flow starts upon initialization of the printer or hardware power-ON (step 1201) (the flow starts when the printer is set up or may have been moved). Upon initialization of the table (step 1202), the step table 104-*a* that realizes the manufacturer's guaranteed speed is selected. The carriage scanning driving (CR motor 3 driving) is done based on this curve (step 1203), and the above-mentioned out-of-phase detector detects an out-of-phase state (step 1204). If the detector does not detect any out-of-phase state (the motor never reaches the out-of-phase state when it is driven by the initial table 104-*a*), the motor output torque is lowered, i.e., the step table 104-*a* is altered to the table 104-*b* to increase the carriage scanning speed (step 1205). Thereafter, the CR motor 3 is driven again (step 1203). This loop is repeated until an out-of-phase state is detected. For example, if an out-of-phase state is detected when the table 104-*c* (high-speed table) is used (step 1204), an appropriate margin is added to the table used at that time, and the table 104-*b* that defines a lower speed than the out-of-phase table is selected (step 1206), thus ending the flow (step 1208). In this embodiment, three different tables are used. However, when the number of tables is increased, the CR motor 3 can be driven by the tables that can accurately reflect the printer state.

In this embodiment, an appropriate margin can be maintained independently of variations of the motor or machine. In this embodiment as well, the motor to be controlled is not limited to the CR motor 3, and the torque margin of the motor may be used to obtain a current or voltage drop in place of alteration of the motor speed.

As can be seen from the above description, according to the present invention, since the out-of-phase state of the stepping motor is detected or presumed, and the driving step table is altered and set, an appropriate step table can be assured in correspondence with the use environment and state of the printer. As a consequence, the motor rotational speed can be increased by utilizing excessive torque energy, and a printer with high performance can be provided.

As a means for maintaining an appropriate margin, the driving voltage or current of the motor may be altered and set to reduce consumption power, and to prevent deterioration of the torque characteristics caused by temperature rise of the motor.

What is claimed is:

1. A recording apparatus having an open-loop controlled stepping motor as a driving source, comprising:

presuming means for presuming an out-of-phase of the stepping motor in accordance with a using condition or a using environment of the stepping motor;

a plurality of step tables which hold pulse rates corresponding to a plurality of print speeds, said plurality of step tables each having a different drive torque; and control means for controlling driving of the stepping motor using one of said plurality of step tables, wherein said control means selects one of said step tables having a drive torque that will not place the stepping motor out-of-phase when said presuming means presumes the out-of-phase of the stepping motor.

2. An apparatus according to claim 1, wherein said presuming means comprises means for counting a total use rotation count or total use time of the stepping motor.

3. An apparatus according to claim 1, wherein said presuming means comprises means for detecting an ambient temperature or motor temperature.

4. An apparatus according to claim 1, wherein said recording apparatus comprises a serial printer.

5. An apparatus according to claim 1, wherein said recording apparatus comprises an ink-jet printer.

6. A recording apparatus for moving a recording head to attain recording scanning, said apparatus comprising:

an open-loop controlled stepping motor for driving a carriage having the recording head;

count means for counting a scanning number of the carriage;

storage means for storing the scanning number of the carriage counted by said count means;

a plurality of step tables which hold pulse rates corresponding to a plurality of print speeds, said plurality of step tables each having a different drive torque;

holding means for holding at least one carriage scanning number threshold value; and control means for controlling driving of said stepping motor using one of said plurality of step tables, wherein said control means drives said stepping motor using a predetermined one of said plurality of step tables, counts the scanning number of the carriage using said count means and stores the scanning number in said storage means, compares the stored scanning number with the threshold value held by said holding means, and selects one of the step tables having a drive torque that will not place said stepping motor out-of-phase when the stored scanning number exceeds the threshold value held by said holding means and the out-of-phase is presumed.

7. An apparatus according to claim 6, wherein when said holding means holds a plurality of threshold values, and when said control means selects another step table for said stepping motor, the threshold value to be compared with the scanning number stored in said storage means and held in said holding means is altered.

8. A recording apparatus having an open-loop controlled stepping motor as a driving source, comprising:

a sensor for detecting a temperature or a physical quantity corresponding to the temperature at a predetermined position of said recording apparatus;

a plurality of step tables that hold pulse rates corresponding to a plurality of print speeds, said plurality of step tables each having a different drive torque; and control means for controlling driving of the stepping motor using one of said plurality of step tables, wherein said control means selects one of said step tables having a drive torque that will not place the stepping motor out-of-phase when said sensor detects a value from which the out-of-phase of the stepping motor is presumed.

* * * * *

UNITED STATES PATENT AND TRADEMARK OFFICE

CERTIFICATE OF CORRECTION

PATENT NO. : 5,998,956

DATED : December 7, 1999

INVENTOR(S) : SAITO

It is certified that error appears in the above-identified patent and that said Letters Patent is hereby corrected as shown below:

On the title page, item

[56] Attorney, Agent, or Firm:
"Fitzpatrick, Cella, Cella & Harper" should read --Fitzpatrick, Cella, Harper & Scinto--.

COLUMN 5:
Line 34, "without t" should read --without--.

COLUMN 7:
Line 19, "H sensor" should read --HP sensor--.

Signed and Sealed this

Thirteenth Day of February, 2001

*Attest:*

Nicholas P. Godici

NICHOLAS P. GODICI

*Attesting Officer*

*Acting Director of the United States Patent and Trademark Office*